US005431578A

United States Patent [19]

Wayne

[11] Patent Number: 5,431,578

[45] Date of Patent: Jul. 11, 1995

[54] COMPRESSION MATING ELECTRICAL CONNECTOR

[75] Inventor: Ronald G. Wayne, Salinas, Calif.

[73] Assignee: Abrams Electronics, Inc., Castroville, Calif.

[21] Appl. No.: 204,747

[22] Filed: Mar. 2, 1994

[51] Int. Cl.[6] ..... H01R 13/631

[52] U.S. Cl. ..... 439/259; 439/263

[58] Field of Search ..... 439/259, 263, 284, 287, 439/295, 262, 288, 290, 291

[56] References Cited

U.S. PATENT DOCUMENTS

| | | | |
|---|---|---|---|
| 3,208,030 | 9/1965 | Evans et al. | 439/884 |
| 4,373,764 | 2/1983 | Ulrich | 439/263 |
| 4,500,159 | 2/1985 | Briones et al. | 439/620 |
| 4,530,553 | 7/1985 | Aujla | 439/263 |
| 4,544,227 | 10/1985 | Hirose | 439/607 |
| 4,560,222 | 12/1985 | Dambach | 439/263 |
| 4,602,838 | 7/1986 | Davis et al. | 439/354 |
| 5,035,639 | 7/1991 | Kilpatrick et al. | 439/850 |
| 5,147,215 | 9/1992 | Pritulsky | 439/344 |

*Primary Examiner*—Gary F. Paumen

*Attorney, Agent, or Firm*—LaRiviere, Grubman & Payne

[57] ABSTRACT

An electrical connector system for providing low-loss, long-life electrical connection over many repeated coupling/uncoupling cycles. The connector utilizes ribbon contacts flexibly deformable in one axis to make electrical connection, substantially without sliding and compression friction during coupling and uncoupling. The connector comprises a receptacle and a plug, the plug housed within a shell. The plug is inserted almost fully into the receptacle before electrical or mechanical connection is made between corresponding contacts. A cam disposed in the shell flexes a contact mounting blade on the receptacle at the end of insertion, to bring the contact of the receptacle into electrical connection with the corresponding contact of the plug.

22 Claims, 5 Drawing Sheets

COMPRESSION MATING ELECTRICAL CONNECTOR

TECHNICAL FIELD

The present invention relates to electrical connectors. Specifically, the present invention relates to long-life, high reliability electrical and electronic signal connectors which are capable of many thousand couple/-decouple cycles without significant increase in contact resistance or loss of signal.

BACKGROUND ART

The use of electrical connectors to removably couple electrical or electronic components, cables or wires is well known in the art. A feature common to almost all electrical connectors is the use of conductive contacts to establish electrical conductivity. Conductive contacts are typically fabricated from base metal, e.g.: copper or brass. In order for low-loss electrical conductivity to be established between two metallic contacts which are not soldered or otherwise rigidly connected, the contacts must be firmly held together. The presence of any non-conductive material between a pair of contacts tends to reduce or eliminate their electrical conductivity.

A problem common to the manufacture of electrical contacts is that the material frequently used for such contacts generates, through chemical action, corrosion products which inhibit or prevent electrical conductivity. For instance, copper contacts which are exposed to atmospheric sulfur tend to form cuprous or cupric sulfates. The process of forming these copper sulfates reduces conductivity between the contacts in several ways. First, these corrosion products themselves tend to be poor conductors of electricity. Second, the process of the chemical formation of these corrosion salts pits and corrodes the surface of the two contacts thereby reducing the surface area available for contact and maximized transfer of electrons. Finally, a corrosion product interposed between mating electrical contacts act as an abrasive and tend to increase the physical separation, and hence the resistance of those contacts to electrical flow.

While the preceding discussion has used copper contacts as an example, the same problem exists, to a greater or lesser degree, with most metallic contacts. The problem is aggravated when the contacts are formed of different metals having different electrode potentials. As is well known, contact between two such dissimilar metallic contacts, particularly in the presence of a substance acting as an electrolyte, results in some degree of bimetallic corrosion.

The high power typically encountered in some electrical applications, electrical power transmission equipment for instance, tends to overcome imperfections in electrical contacts. Furthermore, power transmission connectors are generally subjected to relatively few connect/disconnect cycles during their life span. For these reasons, as well as cost considerations, many electrical contacts are fabricated from base metal and utilize a sliding compression to effect connectivity. Contact corrosion and erosion is a significant problem however, in the electronic arts where low power applications are common. A low power electronic signal is especially susceptible to signal loss due to contact corrosion. For all the previously discussed reasons, it is standard practice in applications requiring a high degree of electrical reliability and low signal loss, to plate the respective electrical contact pairs with a metal which is resistant to corrosion. One well known such metal is gold.

Pure gold is a relatively dense, soft metal and is an excellent conductor of electricity. In its unalloyed state, gold tends to abrade easily. Due to many factors, not the least of which is the cost of gold, the thickness of gold plating for electrical contacts is typically in the range of 50 millionths of an inch (50/1,000,000″). Gold plating of this thickness is sufficient to ensure near perfect electrical conductivity when electrical contacts are newly plated. Furthermore, the presence of such gold plating over a base metal contact pair significantly reduces the vulnerability of the substrate base metal to oxidative, corrosive or bimetallic attack.

The need for gold-plated high-reliability electrical contacts was highlighted in a recent Congressional probe. Dr. Puckett, the General Manager of Hughes Aircraft Co., was called in front of a Congressional committee investigating defense contractor charges. One of the senators asked, "Dr. Puckett, Hughes is well-known as the 'Cadillac' of the defense industry. Can you explain to me why every one of the electrical contacts you sell the government has to be gold-plated?" Dr. Puckett replied, "Why, you know the answer to that question as well as I do, Senator. Gold plating electrical contacts is much cheaper than machining them out of solid gold."

As was previously discussed, it is necessary to maintain a contact pair in immediate contact to ensure a reliable, electrically conductive path. Prior art electrical connectors generally utilize some form of sliding or compressive friction to ensure the conductivity between two contacts. A commonplace example of a sliding friction contact is the ordinary 110 volt wall plug and mating lamp cord plug, wherein a pair of copper prongs are seated in a pair of spring loaded copper or copper alloy receptacles. The receptacles contain spring clips, or the like, which are pushed aside under friction as the prongs enter. While the sliding friction of the prongs (or plug) as they are pushed into the receptacles has the effect of removing insulating corrosive or oxidative products from the prongs and receptacles, it also produces some degree of wear. This design is perfectly adequate for typical household or light industrial service. However, such an unplated plug and receptacle pair generally yields an unacceptable level of signal loss when used in many electronic applications, particularly those with highly repetitive coupling/decoupling requirements. This signal loss therefore gives rise to the use of the gold plating previously discussed.

Efforts by other workers in the electrical and the electronic arts have yielded a plethora of electrical contact systems for general and specialized uses. Apparently all of them utilize some form of sliding or compression friction to establish and maintain electrical contact between connector elements. Representative examples of such electrical connector systems are found in the following U.S. Patents: U.S. Pat. No. 3,208,030 to Evans, et al.; No. 4,500,159 to Briones, et al.; No. 4,544,227 to Hirose; No. 4,602,838 to Davis, et al.; No. 5,035,639 to Kilpatrick, et al.; and No. 5,147,215 to Pritulsky. Each of the aforementioned prior art patents utilizes a sliding or friction contact system which aggravates the previously discussed wear problem.

The use of gold-plated contacts for high-fidelity or precision electronic components is not, however, without its faults. Not the least of which is the fact that gold, being a relatively soft metal, is very susceptible to the mechanical wear between contacts which is caused by coupling and decoupling a connector. This mechanical wear is aggravated by any form of abrasive material entrained between the mating contact pair, and eventually acts to remove the gold layer and expose the base metal substrate to the corrosive processes previously discussed. For many applications, gold-plating a contact pair which will mate with sliding friction is a perfectly adequate methodology. Commonly, in these applications the number of times a connector is coupled and uncoupled tends to be relatively low, so the cumulative effect on overall conductivity of abrasives, entrained between contact elements, is negligible.

In order to produce the intimate contact between contacts required for low-loss connectivity, one prior art methodology is to spring-load one rigid contact face to bias it toward another contact, also having a rigid face. However, rigid-faced contacts are limited to a fixed contact area unless friction mating is utilized which in turn introduces the mechanical wear problem previously discussed.

Some connectors, such as those used on headphones are connected and disconnected from their respective electronic devices many times per day. Examples of such headphone use include sonar sets, transcription machines, PBX switchboards and so forth. Connectors for use with headphones on these equipments must deliver a consistently high standard of conductivity while being coupled and decoupled many thousands of times, and present a significant design challenge.

A gold-plated, base metal contact pair which operates under the principal of rotating or sliding friction is generally incapable of delivering low-loss conductivity over many thousand coupling/decoupling cycles. This is due to mechanical wear caused by sliding friction, exacerbated by the abrasive effect of corrosion products, airborne contaminants, and dust on the gold plating. Such frequency of coupling and decoupling tends to remove sufficient gold plating from the contacts that the previously discussed signal loss problem returns.

An electrical connector capable of being connected and disconnected without appreciable sliding friction, and attendant wear between the corresponding contacts thereof, would obviate the abrasion problem which shortens the life of high couple/decouple cycle connectors. Such a connector would provide significant advantages in reliability and life span.

DISCLOSURE OF INVENTION

The present invention overcomes the previously discussed contact abrasion problem and its concomitant loss of electrical current flow and signal strength through the use of paired contacts which are not in mechanical or electrical contact with one another as the plug is inserted into the receptacle. An electrical contact as taught by the present invention comprises a flexible conductive spring, or ribbon, the contact surface of which is flexibly deformable in at least one axis. By rollably deforming at least one of the contact's faces with respect to another contact, an intimate, relatively large area electrical contact is established and maintained without the sliding friction inherent in prior art electrical connectors.

One or more wires may be attached to each of the contacts of the present invention. Such wires are often insulated, and the present invention contemplates several methods for rapidly attaching the contacts to such insulated wires, including soldering, compression or swage fitting, screw terminals or other methods for connecting wire as are well known in the art. In the preferred embodiment, this connection is accomplished by providing each of the contacts with at least one tooth capable of being driven through insulation surrounding an electrical wire, and thereby making contact with that wire.

Contacts according to the present invention are executable in a variety of materials, most commonly copper or copper alloys including semi-hard brass, but also including nickel, silver, gold, alloys thereof, carbon (graphite) or any other electrically conductive and substantially resilient metallic or non-metallic substance. Contacts constructed according to the principles of the present invention may be plated, for instance with gold, or left unplated.

One embodiment of the present invention comprises a connector system including a plug, a receptacle and a shell. According to this embodiment, contacts are mounted on support structures formed on each of the receptacle and shell. These support structures are hereinafter referred to as carriers or blades. Fully inserting the plug into the receptacle completes the connection between corresponding plug and receptacle contacts without sliding friction therebetween.

The receptacle of this embodiment comprises a lipped recess, into which the plug is inserted. The receptacle support structure, according to this embodiment, is a substantially flexible blade. The contact support structure on the plug is formed as a substantially rigid blade. The plug is assembled in a shell and is free to travel in at least one axis, within certain limits, inside that shell. The shell has a bias mechanism, or spring, for biasing the plug in one direction and at least one stop for limiting plug travel in the shell. The shell has an interior cam surface for engaging the flexible blade of the receptacle.

At the start of the insertion process, and for most of that process, the corresponding plug and receptacle contacts are aligned, but not in contact. When the receptacle contacts are superposed over the plug contacts, the lip of the receptacle engages a face of the plug and, as the receptacle continues to be inserted, starts to push the plug further in the shell. The bias mechanism, working in opposition to insertion force, maintains the receptacle and plug as a substantial unit during this later phase of insertion. In this manner, the receptacle and plug are maintained in substantial alignment while the two are pushed as a substantial unit further into the shell. After the receptacle lip engages the plug face, and as insertion continues, the flexible blade of the receptacle is engaged by the cam surface. Continuing the insertion process causes the cam surface to apply an articulation force to the flexible blade, thereby forcing the blade substantially downward and rollably deforming at least one of the contacts with respect to, and into physical contact with, the other. This rollable and compressive deformation results in, and ensures positive, repeatable contact without substantial abrasion.

In this implementation, at least one detent latch is provided to removeably latch the plug and receptacle together. This latch ensures that the electrical connection established between corresponding contacts is maintained by compressive deformation until it is desired to decouple the connection. This latch, or detent, is formed on the shell and receptacle assembly of the present invention.

While the preceding discussion has assumed a connector system with only one contact pair, the present invention may, with equal facility be applied to electrical connector systems requiring a plurality of corresponding contacts.

It is a particular feature of the present invention that the corresponding contacts thereof are not mated under any substantive sliding friction. Rather, an electrical connector as taught by the present invention, and comprising a plug, sleeve, and receptacle system as discussed above, achieves and maintains electrical connection by compressing and deforming at least one of the contacts against the other. By utilizing this deformational or rollable compression, electrical contact is made over a substantially large area without substantial sliding friction.

The compressively deformable contacts of the present invention are implementable as arcuate springs or essentially oval or circular loops of conductive leaf spring material. The present invention may further be practiced by forming leaf spring material into other geometries, so long as electrical contact is established by rollably deforming at least one of the contacts with the other and is maintained by the compressive deformation of at least one of the contacts with respect to the other. Other features of the present invention are disclosed or apparent in the section entitled: "BEST MODE FOR CARRYING OUT THE INVENTION."

BRIEF DESCRIPTION OF THE DRAWING

For fuller understanding of the present invention, reference is made to the accompanying drawing in the following detailed description of the Best Mode of Carrying Out the Invention. In the drawing.

Figure 1:
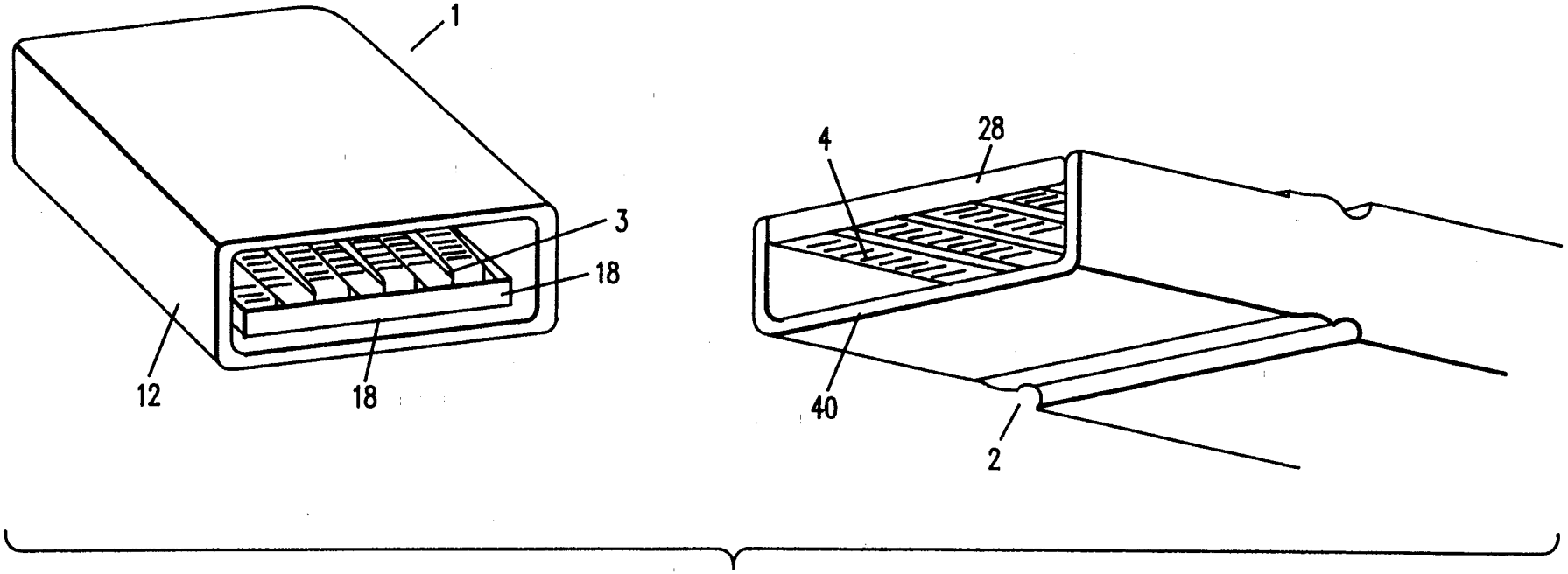
FIG. 1 is a perspective view of the disassembled plug and receptacle assemblies of the present invention.

Reference numbers refer to the same or equivalent parts of the present invention throughout the several figures of the drawing.

BEST MODE FOR CARRYING OUT THE PRESENT INVENTION

Referring to FIG. 1, the external appearance of an electrical connector comprising plug assembly 1 and receptacle assembly 2 is shown. Plug assembly 1 comprises at least one ribbon contact 3, rigid blade 18, and is further assembled in shell 12. Receptacle 2 comprises at least one ribbon contact 4, flexible blade 28, and lip 40.

Figure 2:
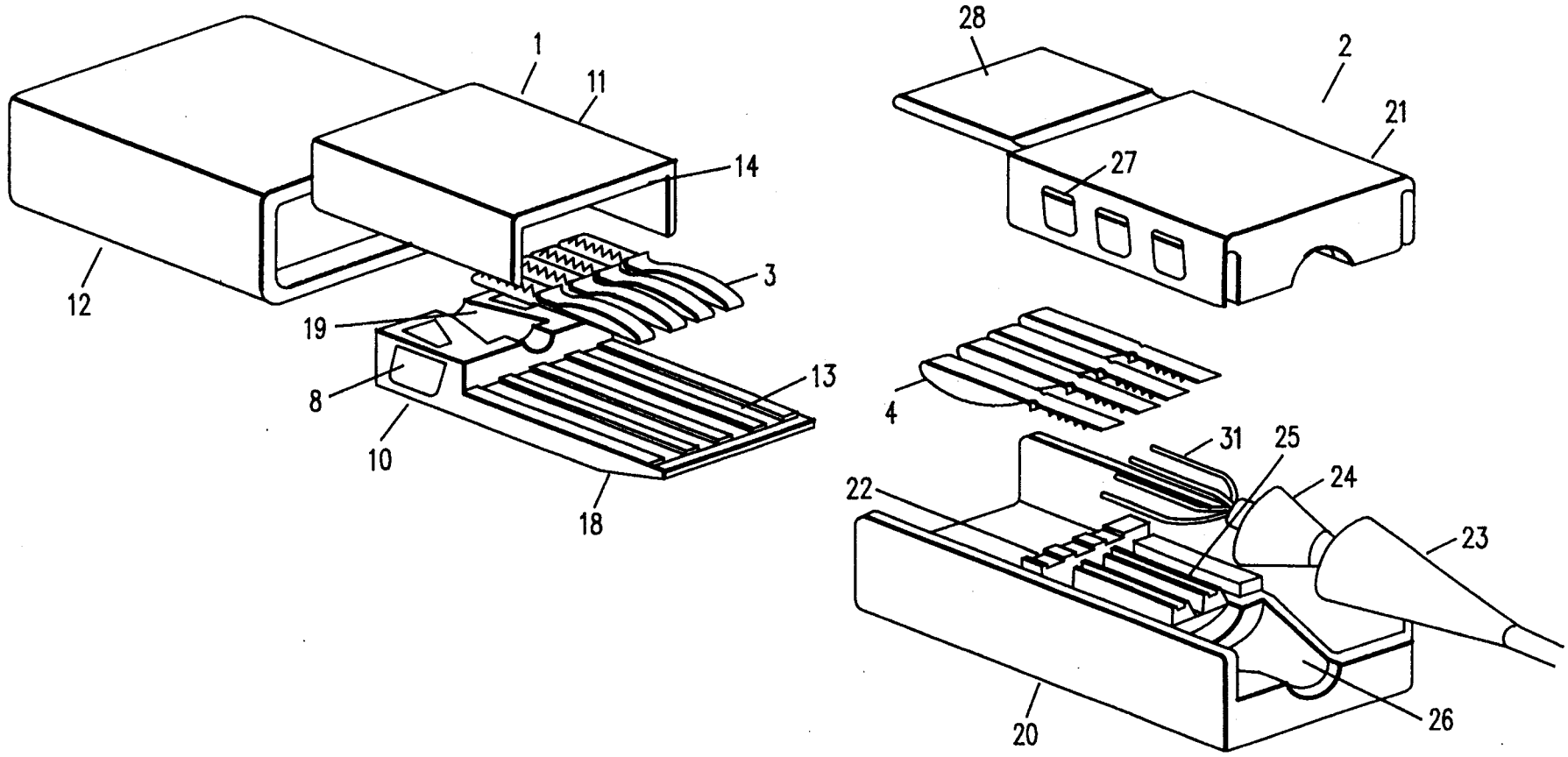
FIG. 2 is an exploded perspective view of the plug and receptacle assemblies of the present invention.

Referring now to FIG. 2, an exploded assembly view of the plug and receptacle of the present invention is shown. Plug 1 comprises a substantially arcuate contact 3 carried on a plug body 10. Plug body 10 defines a first contact carrier formed as a substantially rigid blade 18 having formed therein a contact channel 13 for contact 3. At an end opposite rigid blade 18, a mechanical strain relief 19 is implemented as substantially one half of a conical depression. Contact 3 is retained in position in contact channel 13 by plug cap 11. Plug cap 11 has implemented therein contact channel 14 which mates with contact channel 13 to capture contact 3 therebetween. Not shown in FIG. 2 is a wire channel in substantial coaxial alignment with cable channel 13 and 14 for the purpose of receiving wire 31 therein, and maintaining wire 31 and contact 3 in substantial mechanical alignment and electrical connectivity. Contact 3 terminates wire 31. When assembled as a unit, plug 1 is inserted in shell 12.

Also shown in FIG. 2 is receptacle 2 which is composed of receptacle body 20 and receptacle cap 21. Receptacle body 20 defines a second contact carrier formed as a substantially flexible blade 28 having formed therein a contact channel 13 for contact 4. Contact 4 is captured between receptacle body 20 and receptacle cap 21 in similar fashion as is contact 3 between plug body 10 and plug body 11. Wire channel 25 receives wire 31 contained in cable 23. Also shown as part of plug body 20, is strain relief cavity 26 formed for receiving strain relief plug 24 formed substantially near one end of cable 23. When assembled as a unit, receptacle assembly 2 defines a cavity or recess between receptacle body 20 and receptacle cap 21 for receiving plug assembly 1 therein.

Plug cap 11 is attached to plug body 10, as is receptacle cap 21 to receptacle body 20, by at least one pair of interlocking detents formed in the preferred embodiment as depressions and wedges. Wedge 8 is shown disposed on plug body 10 which, as plug 1 is assembled, snaps into a recess (not shown) on the interior of plug cap 11. In like fashion, receptacle cap 21 has a plurality of wedges 27 cast on either side which, again when receptacle cap 21 is fully assembled snap into depressions cast in the side of receptacle body 20. Alternatively, plug 1 and receptacle 2 could be assembled using adhesives, assembly fluid, rivets, nails, screws, clamps or other assembly methods well known to those skilled in the art.

Figure 3:
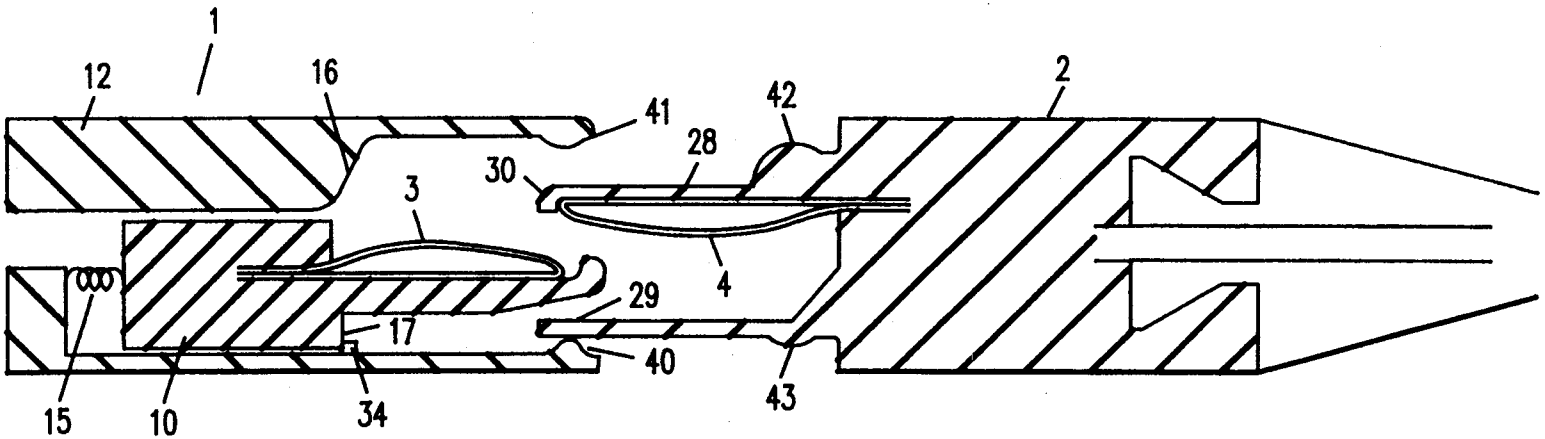
FIG. 3 is a cut-away side view of the present invention at the start of the insertion of the plug into the receptacle assembly.

Shown in FIG. 3 is plug assembly 1 installed in a recess in shell 12, and positioned for insertion into receptacle 2. Plug 1 is biased toward one end of shell 12 by spring 15. Cam 16 is cast as a shoulder inside shell 12 for engaging rounded end 30 of flexible contact arm 28 and for applying a substantially downward articulating force thereto during the final stages of insertion of plug assembly 1 into receptacle assembly 2. Stop 34 limits sliding travel of plug assembly 1 in shell 12.

Figure 4:
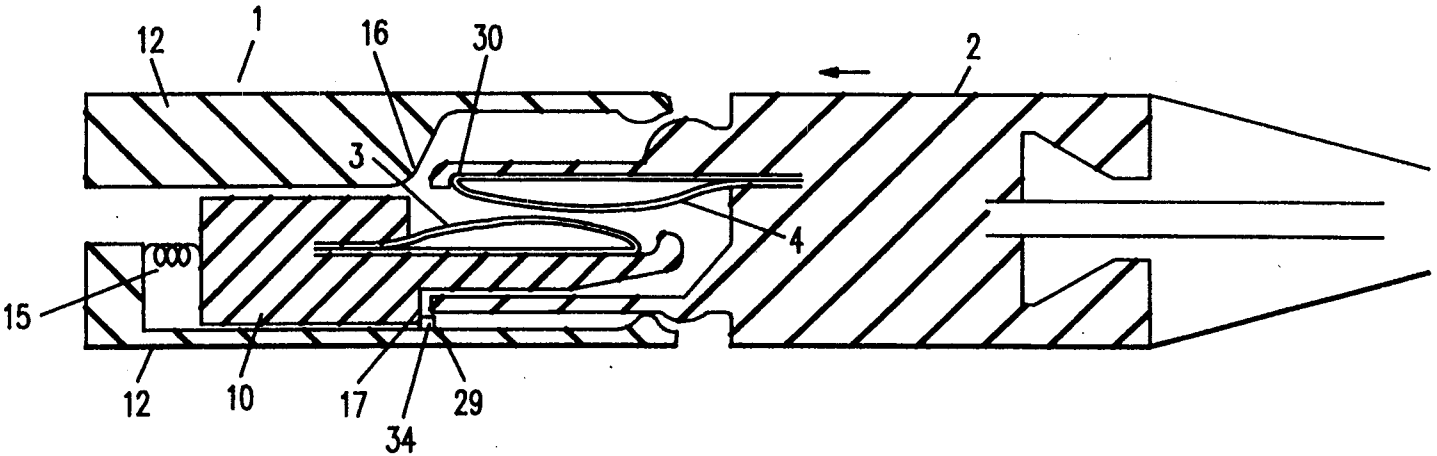
FIG. 4 is a cut-away side view of the plug assembly partially inserted into the receptacle assembly of the present invention, detailing the superposition of the receptacle contact over the plug contact without electrical connection.

As shown in FIG. 4, during final stages of insertion, contact 4 of receptacle assembly 2 is substantially superposed over contact 3 of plug assembly 1 without having made electrical or mechanical contact. At this stage of insertion, an end 29 of receptacle assembly 2 has contacted a lip 17 of plug assembly 1. As insertion continues, end 29 will push plug assembly 1 backwards while maintaining contacts 3 and 4 in the same lateral, superposed position and precluding sliding friction therebetween. During the last stages of insertion, receptacle 2 and plug 1 continue to slide, in substantially mechanical alignment, into shell 12. At this point, rounded end 30 of flexible arm 28 engages cam 16 of shell 12, applying a substantially downward articulating force. This articulating force, bending flexible arm 28 in a generally downward direction, rollably compresses and deforms ribbon contact 3 onto ribbon contact 4. This compressive deformation at least one of ribbon contacts 3 and 4 effects deformational contact therebetween, without appreciable sliding friction. This flexible deformation of at least one of the flexible contacts provides a large contact surface area which is very tolerant of the inclusion of electrically resistive or insulative material entrained between contacts. Additionally, flexible engagement of the contacts significantly reduces the type of mating wear usually experienced in designs which employ sliding friction to establish electrical connection. In making electrical connection without sliding friction, the present invention teaches a connector system capable of 50,000 couple/uncouple cycles, over time, without appreciable increase in resistance across the contacts, or attendant signal loss While the preceding discussion has discussed deforming the contact in only one axis, the present invention specifically contemplates electrical contacts deformable in several axes. When a contact according to the present invention is deformed in more than one axis, such multiaxial deformation may be either simultaneous or sequential.

Figure 5:
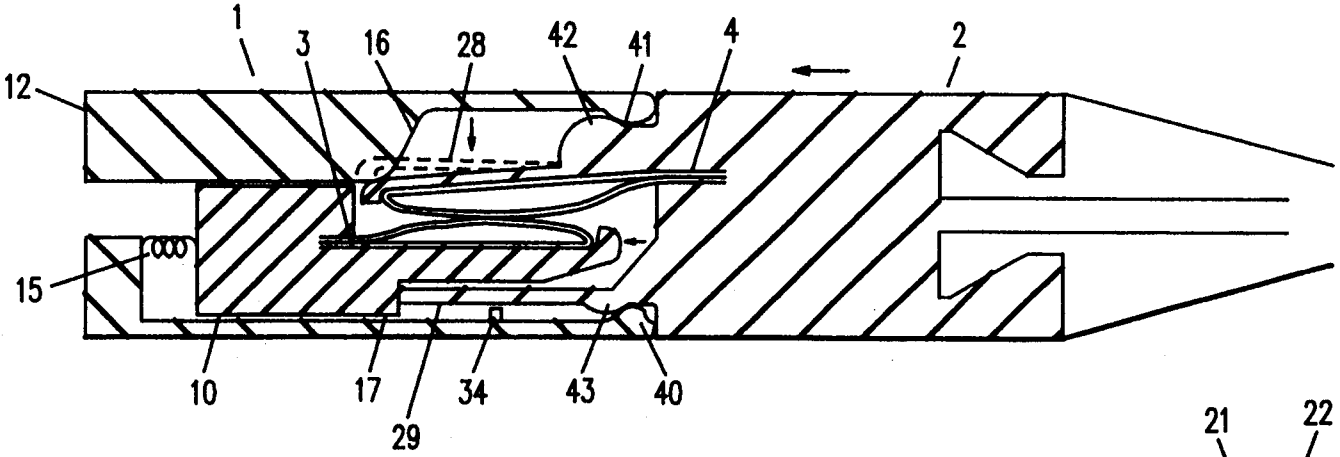
FIG. 5 is a cut-away side view of the plug assembly fully inserted into the receptacle assembly of the present invention.

Referring now to FIG. 5., plug 1 is shown as fully mated within receptacle 2. One end of receptacle 2, numbered 29, has engaged shoulder 17 of plug 1, thereby forcing plug 1 backwards into shell 12 to effect the articulation of flexible arm 28. Articulation of flexible arm 28 causes contacts 3 and 4 to engage and make contact. In compressively engaging contacts 3 and 4, they are substantially deformed in such manner as to increase their surface area. Moderate amounts of resistive or insulative material entrained between contacts 3 and 4 will not preclude conductivity therebetween, as the ribbon contacts deform around such materials and maintain contact. Shell 12 with plug assembly 1 contained therein is maintained in position in receptacle 2 by a pair of detent ridges 40 and 41 disposed on shell 12 which engage paired detent depressions 42 and 43 on receptacle 2. Electrical conductivity is maintained between contacts 3 and 4 by the compressive deformation of those contacts until plug assembly 1 is removed from receptacle assembly 2.

Figure 6:
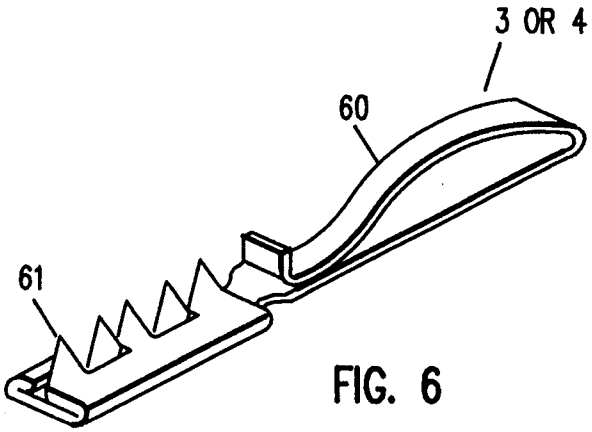
FIG. 6 is a perspective view of a flexible ribbon contact according the present invention.

Details of ribbon contacts 3 and 4 are shown in FIG. 6. Ribbon contact 3 (or 4, the contacts being identical in the best mode) comprises a substantially arcuate flexible and resilient ribbon, or spring, contact 60 having at least one tooth 61 disposed at one end. In the preferred embodiment of the present invention, ribbon contact 3 is formed of half-hard brass which is then successively nickel plated, then gold plated in the arcuate section 60. Alternatively, at least one of ribbon contacts 3 and 4 could be fabricated from: unplated base metal; carbon (graphite or graphite compounds); or metal plated carbon.

Figure 8:
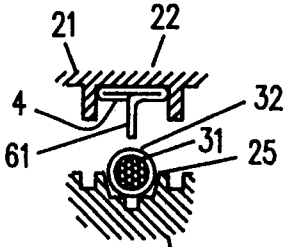
FIG. 8 is a cross-sectional view of a portion of the jack assembly during fabrication, showing the serrated teeth of the ribbon contact prior to piecing the insulation of a wire.
Figure 7:
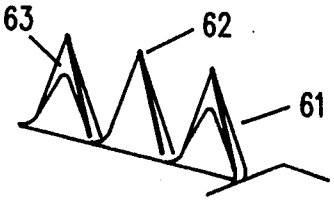
FIG. 7 is a perspective view of the teeth as disposed on a contact according to the present invention, showing the alternating bevel feature thereof.

Tooth 61 is detailed at FIG. 7. Tooth 61 is substantially triangular in shape and is tapered to form a sharp point 62. Alternatively, tooth 61 could be ogive or dentate in profile. As shown in FIG. 8, tooth 61 pierces insulation 32 surrounding wire 31 to terminate wire 31 and provide electrical connectivity therewith. In the preferred embodiment of the present invention, a plurality of teeth 61 are provided to improve insulation piercing and electrical termination. Referring again to FIG. 7, each successive tooth or blade is alternately ground to form an alternating top bevel 63. Forming the teeth in this alternating bevel fashion minimizes insertion effort through insulation 32 while ensuring insertion without deflection of teeth 61 by wire 31. This tooth design further maximizes electrical contact with the strands of wire 31 once inserted.

Once again referring to FIG. 8, a cross-section of one portion of receptacle body 20 and receptacle cap 21 just prior to assembly is shown. Wire 31 is seated in wire channel 25. Ribbon contact 4 is seated in contact channel 22. Insulation piercing teeth 61 are shown prior to piercing insulation 32.

Figure 9:
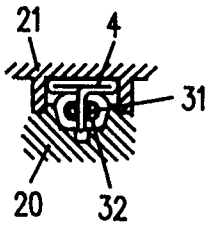
FIG. 9 is a cross-sectional view of the receptacle assembly when completely fabricated, showing serrate teeth having pierced the insulation of a wire and making contact with a wire therein.

At FIG. 9, the same view is shown subsequent to assembly. In this view, piercing teeth 61 have pierced insulation 32 and are making contact with wires 31 therein.

Figure 10:
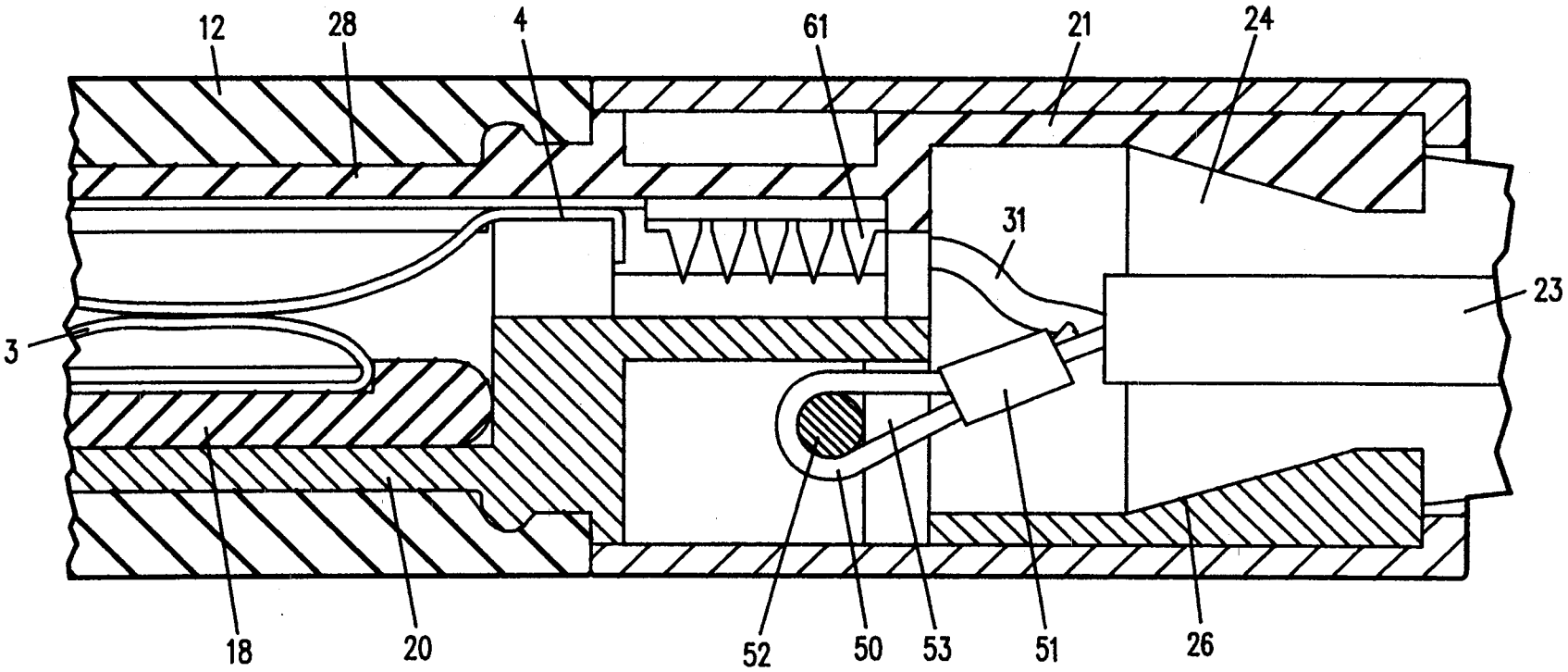
FIG. 10 is a cut-away view of the strain relief feature of the present invention implemented in the receptacle of the present invention.

Referring now to FIG. 10, a mechanical strain relief for relieving strain on wires 31 imposed by pulling cable 23 is detailed. While this figure depicts the receptacle assembly of the present invention, the strain relief depicted therein may be implemented with equal facility on the plug assembly of the present invention. Receptacle body 20 is formed with substantially one half of a conical depression 26. The second half of conical depression 26 is disposed in receptacle cap 21, and when the cap and body are assembled, form the substantially entire conical depression. It will be appreciated by those skilled in the art that the specific shape of the depression may be modified without departing from the teachings of the present invention. Cable 23 has disposed upon it a conical plug 24, which is inserted into depression 26 when receptacle body 20 and receptacle cap 21 are assembled. In this manner conical plug 24 and conical depression act to prevent mechanical strain to the outer covering or sheath of cable 23. Strain to wires 31 is prevented by incorporating in cable 23 a strain relief wire cable 50, which is terminated at one end by a loop 53 formed by swage fitting 51. In this embodiment the connector body (either plug or receptacle) further defines a pair of coaxial transverse holes. Loop 53 may also be formed by splicing strain relief wire cable 51 or other loop forming techniques well known by those skilled in the art. Receptacle body 20 is also formed with a pair of transverse, coaxial holes. Strain relief pin 52 is inserted in the first of these holes, then through the loop formed in strain relief wire cable 50 and finally in the second of the holes. In the best mode, strain relief pin is a mild steel pin. Strain relief cable 50 may also be anchored to receptacle body 20 by rivets, nails, screw fasteners, or other wire fastening techniques well known to those skilled in the art.

Plug body 10, plug cap 11, shell 12, receptacle body 20 and receptacle cap 21 may be implemented in any castable, mechanically stable, electrically nonconductive material. In the best mode of carrying out the present invention, they are injection molded of a thermoplastic polyamide. One such thermoplastic polyamide is DuPont ® Nylon TM. They could, with equal facility and efficacy, be fabricated of various polystyrenes, polyethylenes, ABS, rubbers, elastomers, or other plastics well known in the art. Alternatively, the principals of the present invention may be carried out by machining, heat forming, bending, or casting a variety of alternative materials including, but not limited to: polystyrenes; polyethylene; ABS; epoxies; casting or thermosetting resins; or properly insulated metal.

In the best mode of carrying out the present invention an elastomer, preferably vinyl, having a rebound hardness between 60–80 Shore (Durometer), is used to mold conical plug 24 around cable 23. Alternatively, plug 24 could be formed with equal facility by molding, casting, swaging or adhesively bonding a plug composed of any number of materials having sufficient strength to provide the requisite strain relief. Such materials include, but are not limited to: metals, plastics, composite materials such as Bakelite TM, thermosetting and thermocasting resins, rubber, neoprene, or other elastomers.

In discussion this embodiment of the present invention, the case where the receptacle and plug each have one contact was described. As will be apparent to those skilled in the art, the principles of the present invention may, with equal facility be applied to electrical connector systems requiring a plurality of corresponding contacts. In this case, a method is provided for maintaining the contacts in mechanical alignment and electrically insulating one contact form another. This is typically effected by mounting the individual contacts in a bank of contacts. Connectors which, due to size constraints or number of individual wires terminated therein, are not amenable to formation of a single bank of contacts, may be implemented as two or more banks of contacts. The plug and receptacle assemblies further provide for positioning and aligning the wires terminated therein.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. In particular, the principles and advantages of the present invention are applicable to any pair of electrical contacts, whether plated or not.

I claim:

1. Electrical connector having essentially no sliding friction between electrical contacts, said connector comprising:

a flexible contact disposed on a flexible, cantilevered first carrier means further disposed on a plug means;

a second contact disposed on a rigid, substantially inflexible second carrier means further disposed on a receptacle means;

contact positioning means for superposing said flexible contact over said second contact while said plug means is inserted into said receptacle means, and for precluding contact between said flexible contact and said second contact during substantially full insertion; and articulating means for articulating said first carrier means once said plug means is substantially fully inserted in said receptacle, thereby reversibly deforming said flexible contact onto said second contact and establishing electrical contact between said flexible contact and said second contact.

2. The connector of claim 1 wherein said flexible contact further comprises a first flexible ribbon contact and said second contact further comprises a second flexible ribbon contact.

3. The connector of claim 2 further comprising:

said articulating means further for reversibly deforming said first flexible ribbon contact and said second flexible ribbon contact substantially together.

4. The connector of claim 2 wherein at least one of said first and second flexible ribbon contacts further comprises a substantially arcuate flexible ribbon.

5. The connector of claim 2 wherein at least one of said first and second flexible ribbon contacts is formed from a material selected from the group consisting of: metal, metal plated metal, carbon, and metal plated carbon.

6. The connector of claim 1 wherein said compression means further comprises:

said first contact carrier means and said second contact carrier means further configured for compressively maintaining in said electrical contact said first flexible contact and said second contact.

7. The connector of claim 1 further comprising a plurality of said flexible contacts disposed on said plug means; and further comprising a plurality of said second contacts disposed on said receptacle means.

8. Electrical connector having substantially no sliding friction between electrical contact elements, said connector comprising:

a plurality of substantially arcuate flexible ribbon contacts;

a plug assembly for receiving therein a first plurality of wires, said plug assembly having mounted thereon a first set of said plurality of said ribbon contacts for terminating said first plurality of wires;

a receptacle assembly for receiving therein a second plurality of wires and having a first recess for receiving therein said plug assembly, and having mounted thereon a second set of said plurality of said ribbon contacts for terminating said second plurality of wires;

first and second contact support structures, each having a plurality of contact channels disposed thereon for receiving and aligning said first set and said second set respectively of flexible ribbon contacts, said first and second contact support structures disposed on said plug assembly and said receptacle assembly respectively, for superposing said first set of said flexible ribbon contacts over said second set of said flexible ribbon contacts while said plug assembly is inserted substantially into said receptacle assembly; and for precluding contact between said first set and said second set of said flexible ribbon contacts, until an articulation force flexes said first contact support structure substantially towards said second contact support structure, establishing contact between said first and said second set of said plurality of said ribbon contacts; and a shell for applying said articulating force to said first set of said plurality of said flexible ribbon contacts.

9. The electrical connector of claim 8 wherein said arcuate flexible ribbon contacts each further comprise:

a flat ribbon formed as a spring having a substantially arcuate section at one end; and at least one substantially triangular tooth formed at another end of said flat ribbon, said tooth for piercing wiring insulation.

10. The electrical connector of claim 8 wherein said receptacle assembly further comprises:

a receptacle body forming substantially a first half of said receptacle assembly, said receptacle body having formed thereon at least one wire channel for receiving one said second wire;

a receptacle cap forming substantially a second half of said receptacle assembly; and said receptacle cap and said receptacle body assembled as a substantially whole receptacle assembly after insertion of said one second wire into said receptacle body.

11. The electrical connector of claim 8 wherein said plug assembly further comprises:

a plug body forming a substantial first half of said plug assembly;

a plug cap forming a substantial second half of said plug assembly, said plug cap having formed thereon at least one wire channel for receiving therein said one first wire; and said plug cap and said plug body assembled as a substantially whole plug assembly after insertion of said one first wire into said plug body.

12. The electrical connector of claim 8 wherein further comprising:

said first contact support structure including a rigid blade disposed on said plug assembly; and said second contact support structure including a flexible blade disposed on said receptacle assembly.

13. The electrical connector of claim 12 wherein said shell further comprises a second recess for receiving therein said plug assembly, said shell having disposed, on an interior surface, a cam surface for engaging one end of said flexible blade as said plug assembly is inserted in said receptacle assembly, thereby providing said articulation force for effecting said electrical contact between said first set of said plurality of said ribbon contacts and said second set of said plurality of said ribbon contacts.

14. The electrical connector of claim 13 wherein said shell further comprises:

at least one stop disposed in said shell for limiting said slide travel of said plug assembly within said shell; and at least one bias spring disposed between said shell and said plug assembly, for biasing said plug assembly towards one end of said shell.

15. The electrical connector of claim 13 further comprising a first interlocking detent disposed on said shell and a second interlocking detent disposed on said receptacle assembly, said first and second interlocking detents, when mated, for removably maintaining said shell and said receptacle assembly in mated position, thereby maintaining said plug assembly and said receptacle assembly in mated position.

16. The electrical connector of claim 8 including a mechanical cable strain relief disposed on at least one of said plug assembly and said receptacle assembly, said mechanical cable strain relief comprising:

a plug disposed about one end of a cable;

said one of said plug assembly and said receptacle assembly having a cavity formed therein; and said plug being received into said cavity.

17. Electrical connector for establishing detachable electrical contact, said connector including a plug assembly for receiving therein a first insulated wire and a receptacle assembly for receiving therein a second insulated wire, said receptacle assembly having a first recess for receiving therein said plug assembly, said connector further comprising:

a plurality of substantially arcuate flexible metallic ribbon contacts, each of said contacts having formed at one end at least one piercing blade for piercing insulation surrounding one of said first and second insulated wires and for making electrical contact with said wire;

a plug body forming a substantial first half of said plug assembly, said plug body including a rigid contact blade having formed thereon at least one contact channel for receiving and aligning a first one of said plurality of ribbon contacts;

a plug cap forming a substantial second half of said plug assembly, said plug cap having formed thereon at least one wire channel for receiving therein said first wire and at least one contact channel, said plug cap for retaining said first wire and said first one ribbon contact in mechanical alignment and electrical contact;

at least one first interlocking detent for assembling said plug cap and said plug body as a substantially whole plug assembly after insertion of said first wire into said plug body;

a receptacle body forming substantially a first half of said receptacle assembly, said receptacle body having formed thereon at least one wire channel for receiving said second wire and at least one contact channel, said receptacle body for retaining said second wire and said second one ribbon contact in mechanical alignment and electrical contact;

a receptacle cap forming substantially a second half of said receptacle assembly, said receptacle cap including a flexible contact blade having at least one contact channel formed thereon for receiving one of said ribbon contacts, said receptacle cap for retaining said second wire and said ribbon contact in mechanical alignment and electrical contact;

at least one second interlocking detent for assembling said receptacle cap and said receptacle body as a substantially whole receptacle assembly after insertion of said second wire into said receptacle body;

a shell defining a second recess for receiving therein said plug assembly, said shell having formed, on an interior surface, a cam surface for engaging said flexible contact blade of said receptacle assembly as said plug assembly is inserted in said receptacle assembly thereby precluding electrical and mechanical contact between said ribbon contacts until said ribbon contacts are substantially superposed, thereafter flexing said flexible blade toward said rigid blade of said plug assembly, thereby making electrical contact without sliding and compression friction between said ribbon contacts;

a stop disposed in said shell for limiting said slide travel of said plug assembly within said shell; and a bias spring, disposed in said shell for biasing said plug assembly towards on end of said shell at least one detent disposed respectively on said shell and said receptacle assembly for removably maintaining said shell and said receptacle in mechanical position.

18. The electrical connector of claim 17 wherein said plug assembly further comprises a first mechanical cable strain relief for relieving mechanical strain on said first wire.

19. The electrical connector of claim 17 wherein said receptacle assembly further comprises a second mechanical strain relief for relieving mechanical strain on said second wire.

20. The electrical connector of claim 18 wherein said first mechanical strain relief further comprises:

said plug body forming substantially a first half of a first conical depression, said plug body further defining a first pair of coaxial transverse holes;

said plug cap forming substantially a second half of said first conical depression;

first strain relief wire cable having a first loop formed at one end thereof;

a first cable including a first sheath surrounding said first wire and said first strain relief wire cable, said first loop protruding from one end of said first cable;

a first conical plug formed substantially near said one end of said first cable, and inserted into said first conical depression; and a first strain relief pin inserted through a first one of said first pair of said coaxial transverse holes, said first loop, and a second one of said first pair of said coaxial transverse holes.

21. The electrical connector of claim 18 wherein said second mechanical strain relief further comprises:

said receptacle body forming substantially a first half of a second conical depression, said receptacle body further defining a second pair of coaxial transverse holes;

said receptacle cap forming substantially a second half of said second conical depression;

second strain relief wire cable having a second loop formed at one end thereof;

a second cable including a second sheath surrounding said second wire and said second strain relief wire cable, said second loop protruding from one end of said second cable;

a second conical plug formed substantially near said one end of said second cable, and inserted into said second conical depression; and a second strain relief pin inserted through a first one of said second pair of said coaxial transverse holes, said second loop and a second one of said second pair of said coaxial transverse holes.

22. The method of establishing detachable electrical contact substantially without sliding friction between electrical contact elements, said method comprising the steps of:

terminating a first wire with a first flexible contact disposed on a flexible, cantilevered first carrier means further disposed on a plug means;

terminating a second wire with a second contact disposed on a rigid, substantially immovable second carrier means further disposed on a receptacle means;

inserting said plug means into said receptacle means;

superposing said flexible contact over said second contact using a contact positioning means while said plug means is inserted into said receptacle means, said contact positioning means thereby precluding contact between said flexible contact and said second contact during substantially full insertion;

articulating means for articulating said first carrier means once said plug means is substantially fully inserted in said receptacle, thereby establishing electrical contact between said first flexible contact and said second contact by reversibly deforming said first flexible contact onto said second contact; and reversibly maintaining said first flexible contact in compressive deformity with respect to said second contact.

* * * * *